United States Patent [19]

Tomosada et al.

[11] Patent Number: 4,803,520

[45] Date of Patent: Feb. 7, 1989

[54] ELECTROPHOTOGRAPHIC APPARATUS FOR MAKING SUPERPOSED IMAGES

[75] Inventors: Masahiro Tomosada, Kawasaki; Hiroshi Ogawa; Yoshikuni Tohyama, both of Yokohama; Hideki Adachi, Kawasaki; Tadashi Suzuki, Yokohama; Naoyuki Ohki, Tokyo, all of Japan

[73] Assignee: Canon Kabushiki Kaisha, Tokyo, Japan

[21] Appl. No.: 794,399

[22] Filed: Oct. 31, 1985

[30] Foreign Application Priority Data

Nov. 7, 1984 [JP] Japan ..... 59-234345

[51] Int. Cl.[4] ..... G03G 15/00

[52] U.S. Cl. ..... 355/7; 355/4

[58] Field of Search ..... 355/3 R, 7, 14 R, 14 E, 355/40, 41, 4

[56] References Cited

U.S. PATENT DOCUMENTS

| | | | |
|---|---|---|---|
| 4,340,295 | 7/1982 | Nakamura | 355/14 R |
| 4,346,982 | 8/1982 | Nakajima et al. | 355/3 R |
| 4,378,156 | 3/1983 | Yajima et al. | 355/7 X |
| 4,417,805 | 11/1983 | Kishi | 355/14 R |
| 4,552,449 | 11/1985 | Wakamatsu et al. | 355/14 R X |

OTHER PUBLICATIONS

*Research Disclosure,* Mar. 1983, 22737 "Copying Machine", pp. 116–118.

*Primary Examiner*—Arthur T. Grimley
*Assistant Examiner*—J. Pendegrass
*Attorney, Agent, or Firm*—Fitzpatrick, Cella, Harper & Scinto

[57] ABSTRACT

An electrophotographic apparatus capable of synthesizing two images with a cleaner boundary. Two images are synthesized by forming two images in respectively designated areas, and cleaner boundary is obtained by erasing any image in the boundary zone of these two images.

53 Claims, 8 Drawing Sheets

ELECTROPHOTOGRAPHIC APPARATUS FOR MAKING SUPERPOSED IMAGES

BACKGROUND OF THE INVENTION

1. Field of the Invention

The present invention relates to an electrophotographic apparatus capable of superposed image recording.

2. Description of the Prior Art

Image synthesis in copying has for example been achieved by synthesizing images on an original document and copying thus synthesized original on a copying machine. There is however involved a cumbersome procedure of adhering an original to be synthesized to another original with a transparent adhesive tape, and the obtained original document is often smeared by the use of such adhesive tape.

Apart from such manual image synthesis, automatic image synthesis has been proposed with a copying machine with intelligent functions, but such apparatus is inevitably complex and expensive. It is also possible to effect such image synthesis by forming an electrostatic latent image of a first original image on a photosensitive member, then erasing an unnecessary part of said latent image by selective on-off control of erasing lamps consisting for example of an LED array, then developing and transferring said image through a known electrophotographic process to obtain a partially lacking copy image, then forming another latent image with inverted on-off control of the erasing lamps so that it can be fitted into the lacking portion of the above-mentioned image, and rendering said latent image visible to obtain a synthesized copy image.

However, in the transfer of the developed image from the photosensitive member to the copy sheet, there may result an error in the registration between the front end of the image and that of the copy sheet, and there may also result a shrinkage or elongation of the copy sheet by heat and pressure when it passes the fixing device.

Consequently the above-mentioned image synthesis with inverted on-off control of the erasing lamps frequently results in overlapping boundaries of two images, thus giving rise to synthesized images lacking aesthetic appeal.

SUMMARY OF THE INVENTION

An object of the present invention is to avoid the above-mentioned drawbacks.

Another object of the present invention is to provide an improved image forming apparatus.

Still another object of the present invention is to provide an image forming apparatus capable of forming a blank margin area in the boundaries of the synthesized images, thus avoiding smears in the images caused by an error in registration or a shrinkage or elongation of the copy sheet and providing a clean image.

Still another object of the present invention is to provide an image forming apparatus capable, in image formations in first and second areas, of varying the sizes of said first and second areas to form a blank margin area at the boundaries, thus preventing the image overlapping at the boundaries of image synthesis and providing a clean copy.

Still another object of the present invention is to provide an image forming apparatus capable of forming a blank margin area at the boundaries of first and second image areas by adopting different image magnifications in said two areas, thereby preventing the image overlapping at said boundaries and providing a clean copy.

Still another object of the present invention is to provide an image forming apparatus capable of controlling the amount of a blank margin area on the copy sheet by controlling means for forming first and second images corresponding to first and second image information.

These objects are realized in accordance with the invention wherein an image forming apparatus is provided having area designating means for designating a desired image area, image forming means, and control means for controlling the image forming means such that after an image of a first area designated by said area designating means is formed on a recording sheet, an image of a second designated area is formed on the recording sheet. The control means comprises blank margin forming means for forming a blank margin at the boundary between the images of the first and second areas.

The foregoing and still other objects of the present invention, and the advantages thereof, will become fully apparent from the following description, which is to be taken in conjunction with the attached drawings, as well as from the appended claims.

DETAILED DESCRIPTION OF THE PREFERRED EMBODIMENTS

Now the present invention will be clarified in detail by an embodiment shown in the attached drawings.

Figure 1:
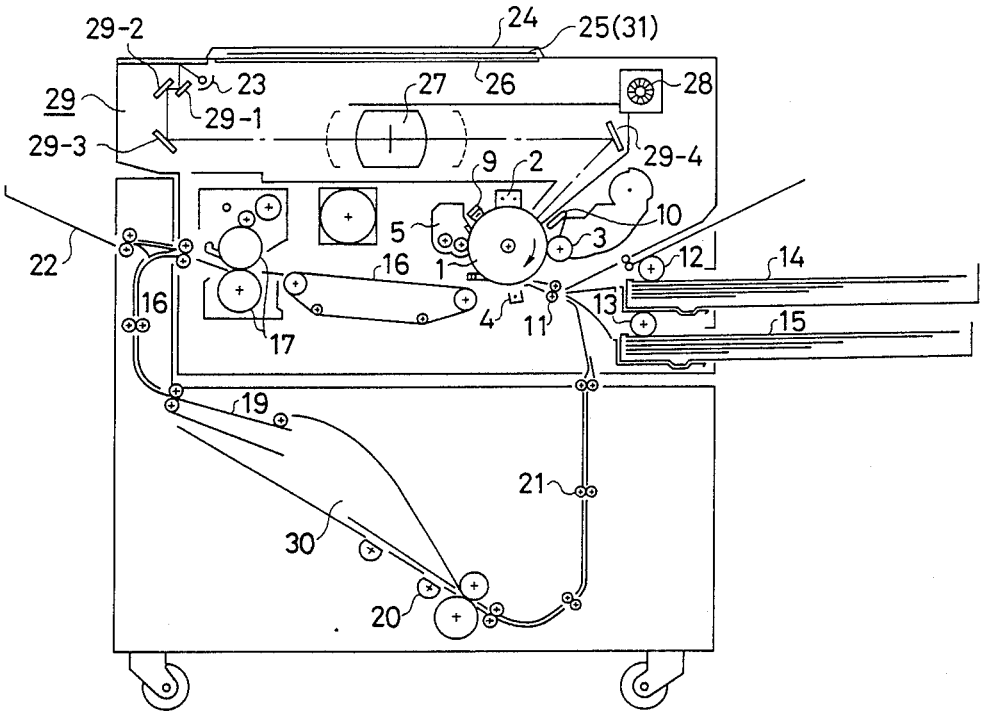
FIG. 1 is a cross-sectional view of a copying machine in which the present invention is applicable.

FIGS. 1 to 8 illustrate an embodiment of the present invention, in which FIG. 1 is a cross-sectional view of a copying machine in which the present invention is applicable. In FIG. 1 there are provided a photosensitive drum 1; a primary charger 2; a developing unit 3; a transfer charger 4; a cleaner 5; a pre-exposure lamp 9; an erasing lamp 10; a registration roller 11; sheet feed rollers 12, 13; copy sheets 14, 15; a conveyor belt 16; and a fixing roller 17 to effect a known electrophotographic process to form a transferred image on said copy sheets 14, 15.

The image synthesis is conducted in the following manner. A first original document 25 is set on an original support glass 26, and unrepresented image synthesis key and copy start key are actuated whereby said first original document 25, maintained in position by a pressure plate 24, is illuminated by an illuminating lamp 23. The reflected light is projected through a mirror system 29 (29-1, 29-2, 29-3, 29-4) and a lens 27 onto said photosensitive member 1 to form a latent image of said first original document 25 thereon. At the same time an erasing amp 10 is on-off controlled to erase the latent image in an area designated by an unrepresented area designating key. The latent image is erased in the area illuminated by said lamp but remains in the unirradiated area, thereby extracting the desired area from the original. The remaining latent image is rendered visible by the developing unit 3. The registration roller is driven at such timing that the leading end of the image on the photosensitive member coincides with the front end of the copy sheet, and the image is transferred by means of the transfer charger 4. Then the sheet is guided to the fixing unit 17 by the conveyor belt 16. In case of an image synthesis, a guide 18 is activated to direct the sheet path toward an intermediate tray 30, into which the copy sheet is stored. Then the aforementioned original document 25 is replaced by a second original document 31 to be synthesized, and said second original document is again illuminated by the illuminating lamp 23. The reflected light is projected through the mirrors 29 and lens 27 onto the photosensitive member 1 to form a latent image of said second original document. For said second original 31, the erasing lamp 10 is so controlled as to erase the latent image outside the area designated for the first original document and slightly inside the boundary of said area. Then the remaining latent image is rendered visible by the developing unit 3, and the copy sheet stored in the intermediate tray is supplied, by means of an intermediate tray feed roller 20 and a transport roller 21, toward the registration roller 11. Said registration roller is driven at such timing that the leading end of the image coincides with the leading end of the copy sheet, and the image is transferred by the transfer charger 4. The copy sheet is then guided by the conveyor belt 16 to the fixing unit 17, and is finally discharged through the guide 18 to a tray 22.

As an alternative method, it is also possible to form a blank margin at the boundary of images to be synthesized, by adopting mutually different image magnifications for the first and second original documents. As an example, the position of the lens 27 and the scanning speed of the illuminating lamp 23 are so controlled that the first original document 25 is copied in actual size, while the second original document 31 is copied with a predetermined image magnification, for example an image reduction to 95%.

It is also possible to erase the latent image of the first original document outside a designated area, and to erase the latent image of the second original document inside said designated area.

It is furthermore possible to effect an image synthesis by a plural-page continuous copying mode, in which two originals on the original support glass, or a right-hand half and a left-hand half of an original, are separately subjected to scanning operations.

It is furthermore rendered possible to change the color in a part of the image of a same original, by combining the above-described technology with different developers in the developing unit. For example it is possible,in a copying machine equipped with two developing units, to copy the outside of a designated area with black color, and then to copy the inside thereof with red color.

Figure 2:
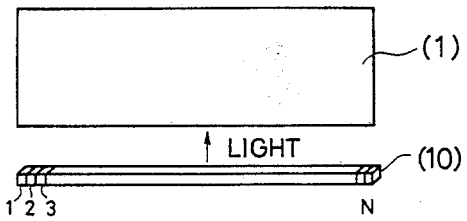
FIG. 2 is a schematic view showing the combination of a photosensitive member and an erasing lamp.

FIG. 2 shows a combination of the photosensitive member 1 and the erasing lamp 10, which is composed of finely divided light-emitting elements, for example an array of light-emitting diodes (LED).

Figure 3:
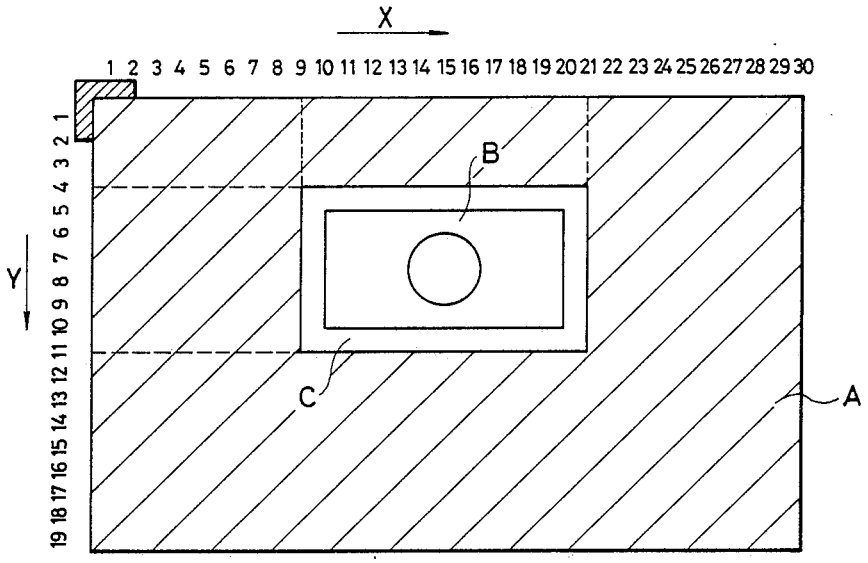
FIGS. 3 and 4 are schematic views showing examples of image output according to the present invention.
Figure 4:
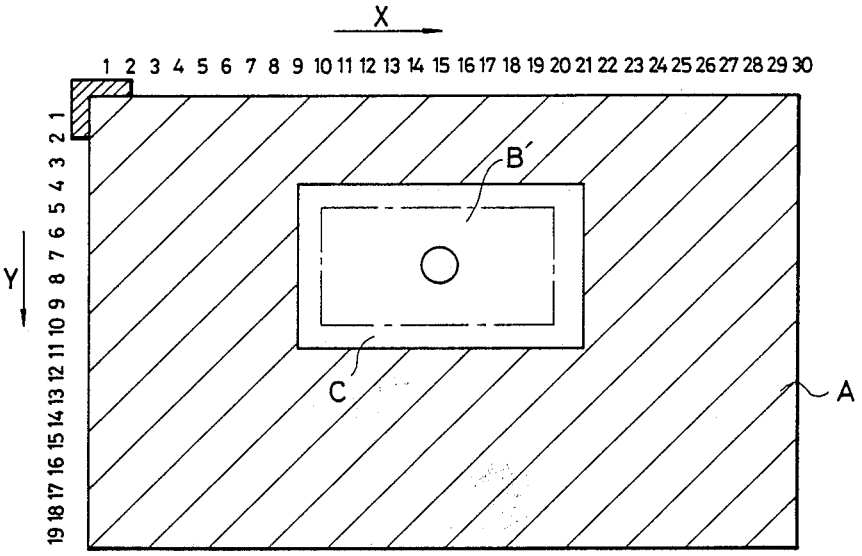

FIGS. 3 and 4 illustrate examples of image synthesis. In the following there will be explained a case of synthesizing an image into a part of another image, as shown in FIG. 3. It is assumed that an area is designated by the diagonal coordinates (9, 4) and (21, 11). At first, in the copying of an area A, the latent image is erased in an area defined by 9 to 21 in the X-direction and 4 to 11 in the Y-direction by lighting the erasing lamp in the corresponding range, and, in the copying of an area B, the latent image is erased outside area C and slightly inside said designated area, i.e. an area defined by 10 to 20 in the X-direction and 5 to 10 in the Y-direction, by lighting the erasing lamp 10 in the corresponding range. According to the present invention, there is formed a blank margin area C which is not subjected to image formation in the copying of area A or B.

In the image synthesis shown in FIG. 4, the image in an area B′ is copied with a predetermined reduction rate. In this case, the erasing lamp 10 is so controlled as to erase the latent image outside an area defined by the coordinates (9, 4) and (21, 11), and the image in said area is copied with a predetermined reduction rate to form a blank margin area at the boundary.

Figure 5:
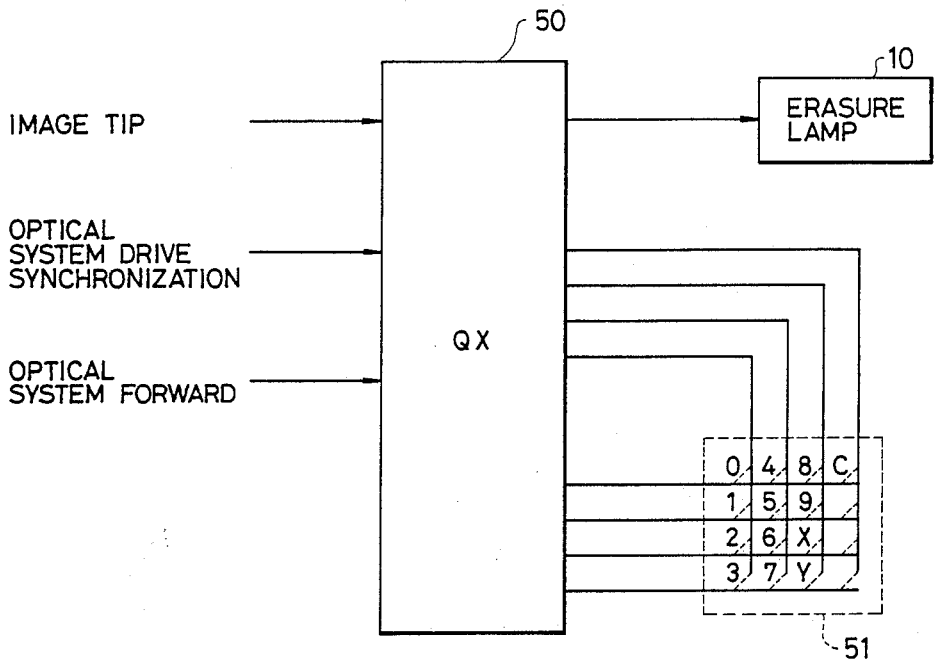
FIG. 5 block diagram of a circuit for forming a blank margin.

In a block diagram shown in FIG. 5, a microcomputer 50 (Qx) designates the area of image synthesis through an input key matrix 51, and controls the on-off timing of the erasing lamp 10, according to data inputs X, Y shown in FIG. 3. Now reference is made to FIG. 6 for explaining the timing in the X-direction. Optical system drive synchronization signals are counted from an image front end signal, supplied from an unrepresented sensor and indicating the front end of the image, and the erasing lamp 10 is controlled, for the first original document, with the timing of signals $1D_0$–$1D_3$ to erase the latent image in the designated area, while it is controlled, for the second original document, with the timing of signals $2D_0$–$2D_3$ for erasing the latent image outside the designated area. T2 indicates the lighting period of the erasing lamp, which is lighted in both copying operations for overlapping periods T1.

Figure 7:
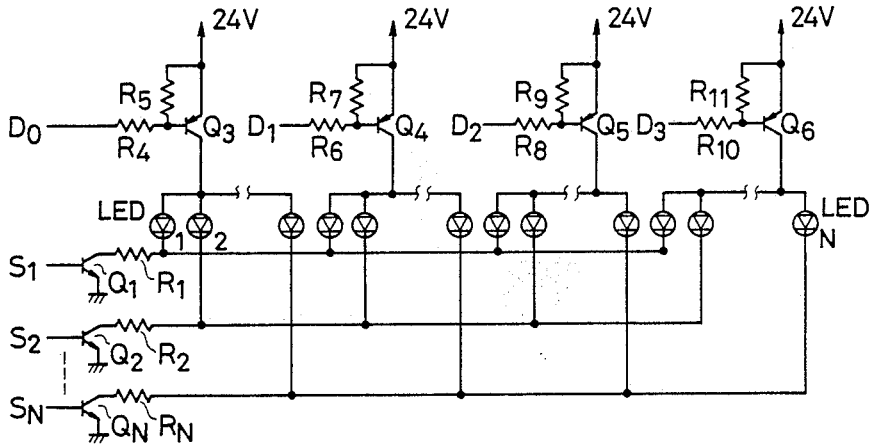
FIG. 7 is a, circuit diagram for driving erasing lamp.

FIG. 7 shows a driving circuit for the erasing lamp 10, wherein provided are transistors $Q_1$–QN, resistors $R_1$–$R_{11}$ and light-emitting diodes LED1–LEDN. In the present embodiment, the erasing lamp 10 is composed of an array of light-emitting diodes, which are used in dynamic lighting mode. Signals $D_0$–$D_3$ and $S_1$–SN are mutually combined to light the LED's at a desired timing, thereby erasing the latent image for effecting image synthesis. The lamp lighting may also be effected in static lighting mode instead of dynamic lighting.

Figures 1, 8:
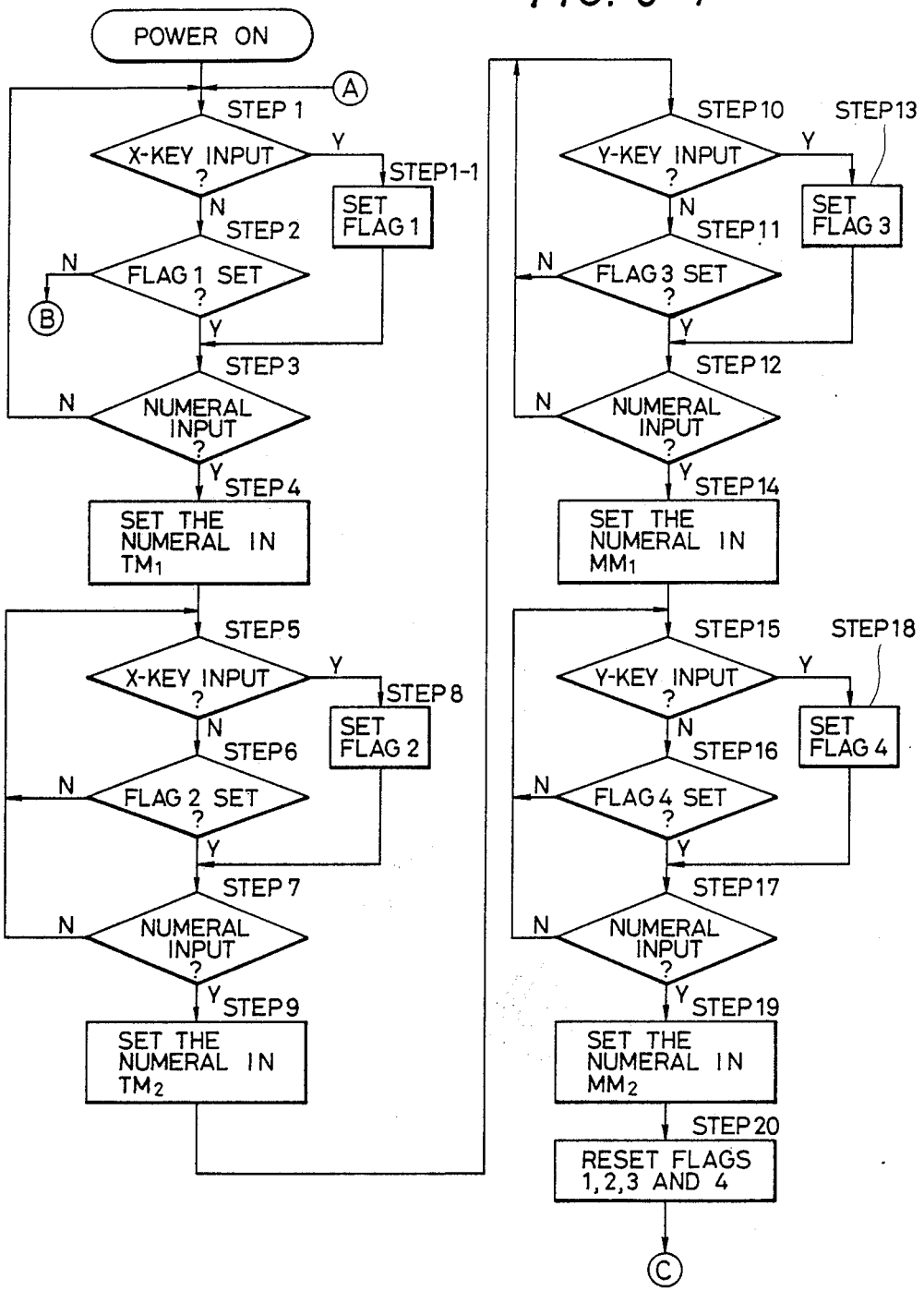
FIG. 8 is a flow chart showing the control sequence according to the present invention.
Figures 2, 8:
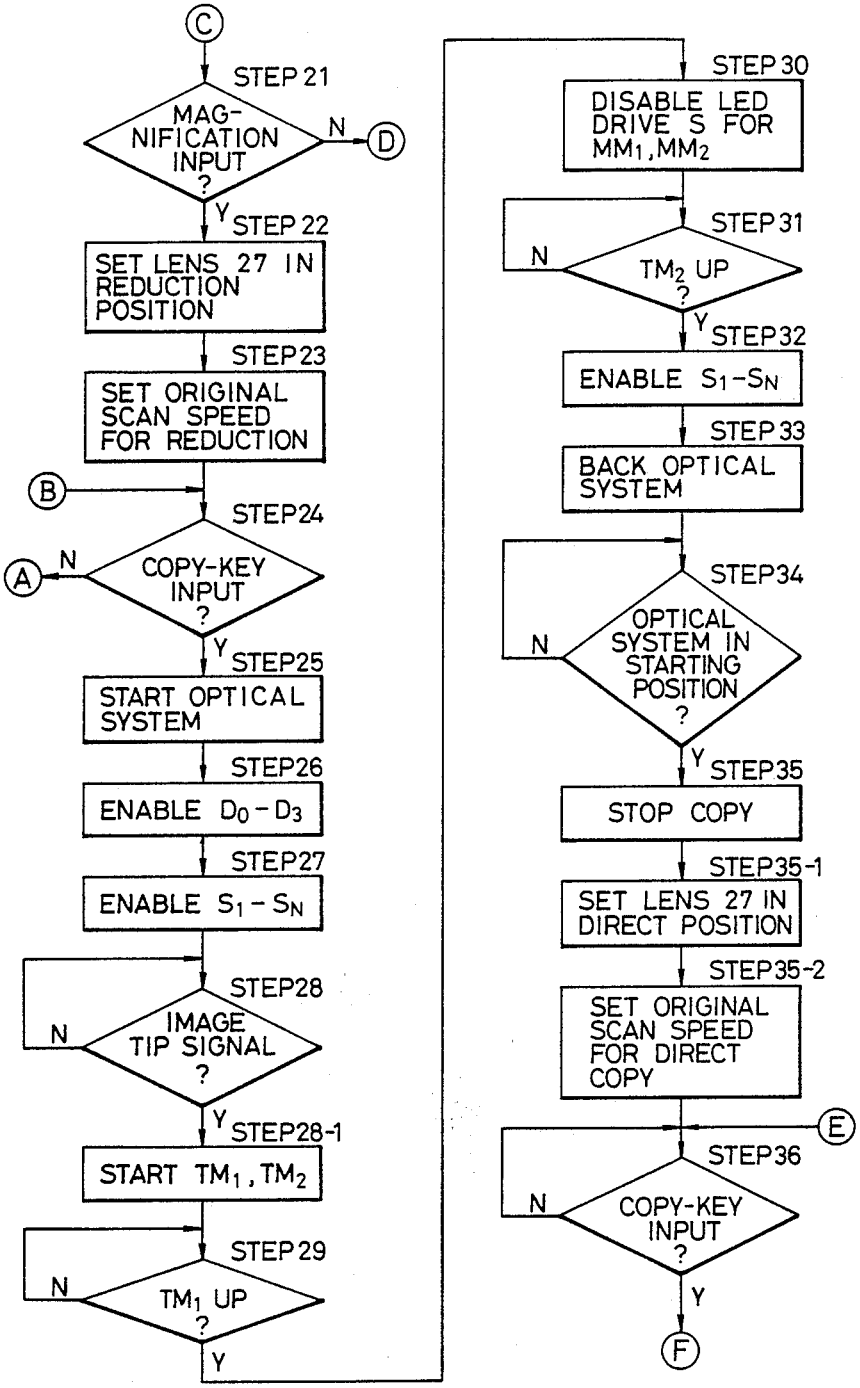
Figures 3, 8:
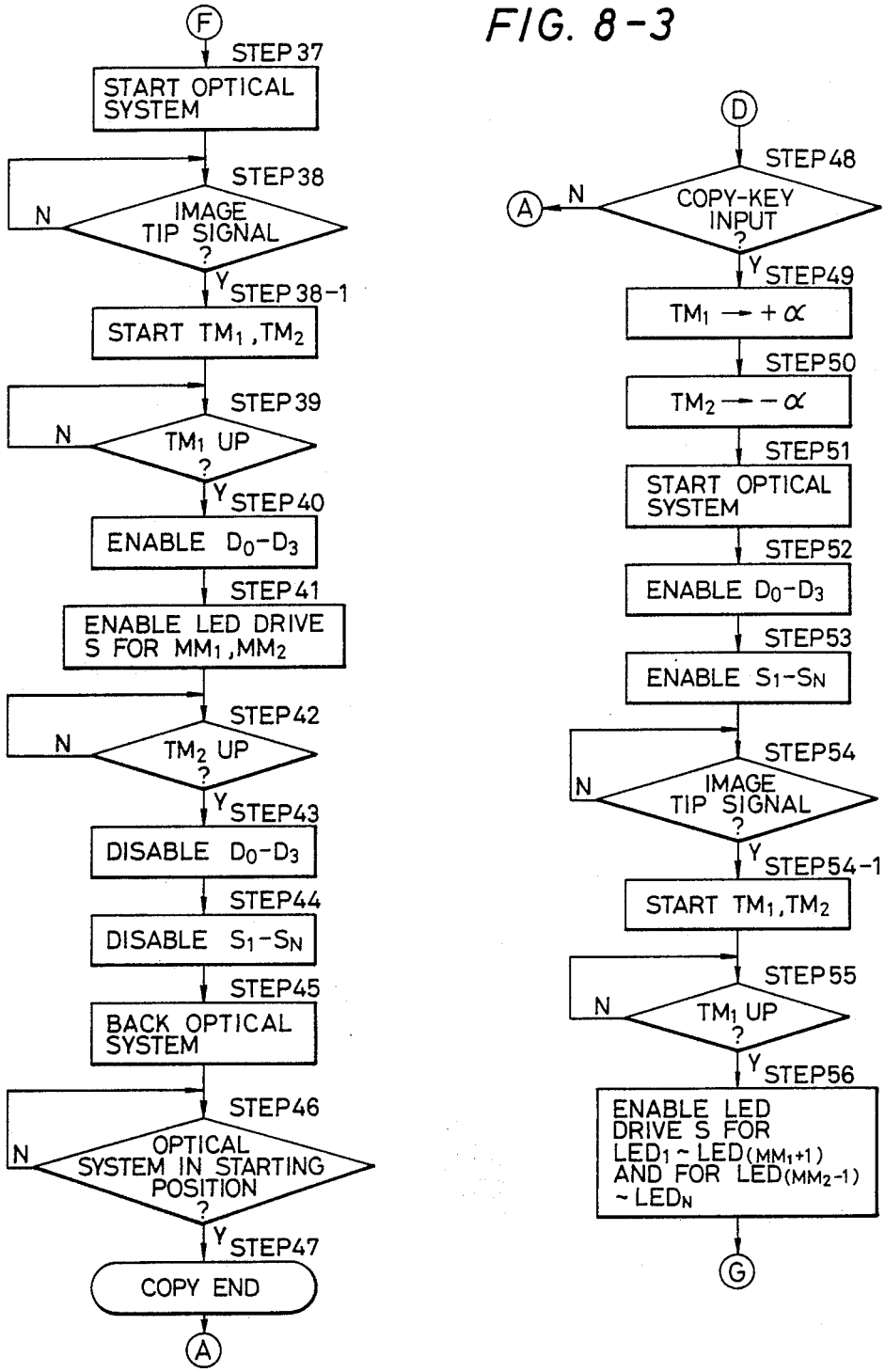
Figures 4, 8:
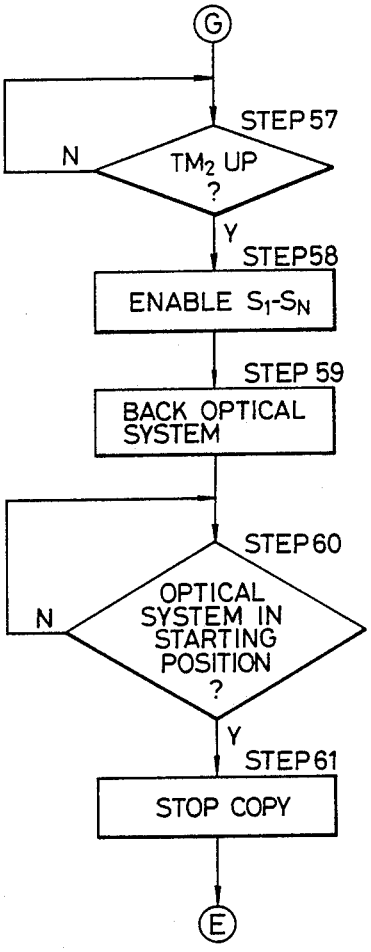

Now reference is made to FIG. 8 for explaining the control by the microcomputer Qx. The present flow chart determines the lighting time of the erasing lamp, wherein steps 1–9 identify whether a number is set for the X-direction after the power supply is turned on. At first a step 1 identifies whether an X-key, indicating the image synthesis area in the X-direction, has been actuated, and, if actuated, a flag 1 is set in a step 1-1. In the absence of such actuation, a step 2 identifies whether the flag 1 is already set.

If the flag 1 is already set, or after the execution of the step 1-1, a step 3 identifies whether a number for designating an area, has ben entered. In the absence of such number setting, the program returns to the step 1. In the presence of said number setting, the set number is set in a timer TM1 (step 4). Then, in a similar manner as explained above, steps 5 to 9 sets, in a timer TM2, a set number indicating the end of the image synthesis area in the X-direction. In this manner the control in the X-direction is achieved by time in relation to the scanning of the optical system or the rotation of the photosensitive drum, and the start and end of lamp function in the X-direction are defined by the numbers set in the timers TM1, TM2. The image synthesis area in the Y-direction is also designated through a similar procedure in steps 10 to 19, by setting numbers in memories MM1, MM2 and resetting flats 1–4. In this manner the numbers in the Y-directions correspond to the elements S1–SN of the erasing lamp or LED array. Thus the image synthesis area is designated in the original document placed on the original support glass, as shown in FIGS. 3 and 4, by input of the numbers in the X- and Y-directions.

Then a step 21 identifies whether the image magnification has been selected for the second copy image. If it has been entered, a step 22 moves the lens 27 to a position corresponding to the selected reduction ratio, then a step 23 selects a scanning speed corresponding to the selected image magnification, and a step 24 awaits the actuation of the copy start key. If the image magnification has not been entered in the step 21, a step 48 awaits the actuation of the copy start key. In the presence of such selection of image magnification, the optical system is started at the selected speed in a step 25 or 51. On the other hand, in the absence of such selection of image magnification, setps 49, 50 and $+\alpha$and $-\alpha$ respectively to the contents of the timers TM1, TM2 previously set in the steps 4 and 9, in order to form a blank margin area.

Subsequently steps 26, 27, 52 and 53 turn on the LED drive signals D0–D3 and S1–SN, in order to light the erasing lamp. Then, in response to the image front end signal supplied from the unrepresented image front end sensor, steps 28, 28-1 or 54, 54-1 start the timers TM1, TM2, and steps 29 and 55 await the expiration of the timer TM1.

Upon expiration of said timer, a step 30 turns off the LED drive signal S corresponding to a range designated by input values MM1, MM2 in the Y-direction, thereby turning off the LED in said range. However, in the absence of selection of image magnification in the step 21, there are lighted LED's from LED1 to an LED corresponding to a memory value MM1+1 and from an LED corresponding to a memory value MM2−1 to $LED_N$ by turning on the corresponding LED drive signals S alone (step 56). In this manner the latent image is erased to a position slightly inside the designated area, as represented by B in FIG. 3. Then a step 31 or 57 awaits the expiration of the timer TM2, and upon expiration thereof all the LED drive signals S1–SN are turned on to light all the erasing lamps (step 32 or 58). Then the optical system is reversed upon arrival at a reversing position (step 33 or 59), and is stopped at the start position (step 34 and 35, or 60 and 61). On the other hand, in the presence of selection of an image magnification in the step 21, the lens 27 is positioned for equal size imaging (step 35-1), and the scanning speed is set at the equal size imaging (step 35-2).

Then, after the second original document is set, a step 36 awaits the actuation of the copy start key again, and, upon said actuation, a step 37 starts the optical system. Then, in response to an image front end signal (step 38), timers TM1, TM2 are activated in synchronization (step 38-1). Upon expiration of the timer TM1 (step 39), the LED drive signals D0–D3 are turned on (step 40), thereby lighting the LED's corresponding to a range designated by the input values MM1, MM2 in the Y-direction alone (step 41). In this manner the LED's are controlled inversely to the case in the step 30, thereby copying the area A shown in FIGS. 3 or 4, thus obtaining a synthesized image. Upon expiration of the timer TM2 (step 42), the LED drive signals D0–D3 and S1–SN are all turned off, in order to turn off all the erasing lamps (steps 43, 44). Then the optical system is reversed upon arrival at the reversing position and the blank exposure lamps are all turned off (step 45), and, upon arrival of the optical system at the start position, the copying operation is terminated (steps 46,47) and the program returns to the step 1.

As explained in the foregoing, the blank margin area C in the image synthesis shown in FIG. 3 is formed by increasing the number of lighted LED's, while the blank margin area C shown in FIG. 4 is obtained by reducing the size of the image B'.

In the foregoing embodiment the image B or B' is formed at first, but it is also possible to form the image A at first.

Also the blank margin area may be formed by erasing the latent image just outside the boundary of the image A.

Furthermore, it is also possible to change the image magnification of the area A.

Furthermore, the first and second original documents may have areas which are separately designated.

Furthermore the present invention is applicable also to image data stored in a memory or the like.

Naturally the present invention is not limited to the foregoing embodiment but is subject to various modifications within the scope and spirit of the appended claims.

What is claimed is:

1. An image forming apparatus comprising:

area designating means for designating a desired image area of an original, wherein in said area designating means outputs area information indicating said designated area;

exposing means for exposing said original;

image forming means for forming an image corresponding to said original exposed by said exposing means; and control means for controlling said image forming means such that after an image of a first area corresponding to said area information output from said area designating means is formed on area recording sheet, an image of a second area corresponding to said area information output from said area designating means is formed on said recording sheet;

wherein said control means comprises blank margin forming means for forming a blank margin at the boundary between said images of said first area and of said second area by erasing a portion of said image of said first area when forming said image of said first area or erasing a portion of said image of said second area when forming said image of said second area.

2. An image forming apparatus according to claim 1, wherein said blank margin forming means changes the size of said first area or said second area.

3. An image forming apparatus according to claim 2, wherein said blank margin forming means is adapted to reduce the size of the first area or the second area.

4. An image forming apparatus according to claim 1, wherein said image forming means comprises erase means for erasing an image different from said image corresponding to said area information.

5. An image forming apparatus according to claim 4, wherein said image forming means includes a recording medium for forming a latent image corresponding to said image of said original and wherein said erase means comprises light-emitting means for erasing said latent image formed on said recording medium.

6. An image forming apparatus according to claim 5, wherein said light-emitting means is set in array.

7. An image forming apparatus according to claim 1, wherein each of said images of said first and second areas corresponds to one of designated areas of different originals.

8. An image forming apparatus according to claim 1, wherein each of said images of said first and second areas corresponds to one of designated areas of the same original.

9. An image forming apparatus according to claim 1, wherein said images of said first and second areas are formed in different colors.

10. An image forming apparatus according to claim 1, wherein said image forming means comprises transfer means for transferring the image formed on a photosensitive material onto said recording sheet and said control means multi-transfers the image of said second area onto said recording sheet onto which the image of said first area has been transferred.

11. An image forming apparatus according to claim 10, wherein said control means includes feeding means for repeatedly and automatically feeding to said transfer means said recording sheet on which said image of said first area has been transferred.

12. An image forming apparatus according to claim 1, wherein said image forming means comprises transfer means for transferring the image formed on a photosensitive material onto said recording sheet and wherein said synthesizing means multi-transfers the image based on said second image information onto said recording sheet onto which the image based on said first image information has been transferred.

13. An image forming apparatus according to claim 1, wherein said control means controls the same image forming means so as to form said images of said first and second areas.

14. An image forming apparatus according to claim 1, wherein said second area is determined in association with said first area.

15. An image forming apparatus according to claim 14, wherein said second area is outside of said first area.

16. An image forming apparatus comprising:

area designating means for designating a desired image area, wherein said area designating means outputs area information indicating said designated area;

image forming means;

control means for controlling said image forming means such that after an image of a first area corresponding to said area information output from said area designating means is formed on a recording sheet, an image of a second area corresponding to said area information output from said area designating means is formed on said recording sheet;

wherein said control means comprises blank margin forming means for forming a blank margin at the boundary between said images of said first area and of said second area and wherein said blank margin forming means is adapted to adopt mutually different image magnifications for said first and second areas.

17. An image forming apparatus according to claim 16, wherein the image magnification at said first area is selected smaller than that of said second area.

18. An image forming apparatus according to claim 16, wherein said image forming means comprises erase means for erasing an image different from said image corresponding to said area information.

19. An image forming apparatus according to claim 16, wherein each of said images of said first and second areas corresponds to associated designated areas of different originals.

20. An image forming apparatus according to claim 16, wherein each of said images of said first and second areas corresponds to associated designated areas of the same original.

21. An image forming apparatus according to claim 16, wherein said images of said first and second areas are formed in different colors.

22. An image forming apparatus according to claim 16, wherein said second area is determined in association with said first area.

23. An image forming apparatus according to claim 22, wherein said second area is outside of said first area.

24. An image forming apparatus according to claim 16 wherein said image forming means includes a recording medium for forming a latent image corresponding to said image of said original and wherein said erase means comprises light-emitting means for erasing said latent image formed on said recording medium.

25. An image forming apparatus according to claim 24, wherein said light-emitting means is set in array.

26. An image forming apparatus comprising:

area designating means for designating a desired area of an original image wherein said area designating means outputs area information indicating said designated area;

image forming means for forming the image of an area designated by said area designating means;

magnification setting means for manually setting a magnification for forming images; and synthesizing means for controlling said image forming means so as to form images of a first and second area corresponding to said area information output from said area designating means on a same recording material;

wherein said second area is automatically determined in response to said area information of said first area and wherein said image forming means adopt mutually different image magnifications for the formation of images in said first and second areas and wherein the value of said image magnification for said first area can be set by said magnification setting means.

27. An image forming apparatus according to claim 26, wherein said first area is obtained by extracting a designated area of said original image.

28. An image forming apparatus according to claim 27, wherein the image magnification of said first area is smaller than that of said second area.

29. An image forming apparatus according to claim 26, wherein said second area is obtained by erasing a designated area of said original image.

30. An image forming apparatus according to claim 29, wherein the image magnification of said first area is smaller than that of said second area.

31. An image forming apparatus according to claim 26, wherein said first and second area are contained in mutually different original images.

32. An image forming apparatus according to claim 26, wherein said image forming means forms the image of said first area on a recording sheet and thereafter forms the image of said second area on the same recording sheet.

33. An image forming apparatus according to claim 32, wherein said image forming means comprises transfer means for transferring the image formed on a photosensitive material onto said recording sheet and said control means multiply transfers the image of said second area onto said recording sheet onto which the image of said first area has been transferred.

34. An image forming apparatus according to claim 33, wherein said control means includes feeding means for repeatedly and automatically feeding to said transfer means said recording sheet on which said image of said first area has been transferred.

35. An image forming apparatus according to claim 26, wherein said images of said first and second areas are formed in different colors.

36. An image forming apparatus comprising:

image generating means for generating first and second image information;

image forming means for forming an image; and synthesizing means for forming an image based on said second image information on a recording sheet, after an image based on said first image information generated by said generating means is formed on said recording sheet, wherein said synthesizing means comprises control means for controlling said image forming means in order to change the size of a blank margin formed on said recording sheet.

37. An image forming apparatus according to claim 36, wherein said control means is adapted to control the image magnification of said first ar second image information.

38. An image forming apparatus according to claim 36, wherein said control means is adapted to control the image forming area of said first or second image information.

39. An image forming apparatus according to claim 36, wherein said synthesizing means controls said image forming means so as to form said image based on said first and second image information.

40. An image forming apparatus comprising:

area designating means for designating a desired area of an original image, wherein said area designating means outputs area information indicating said designated area;

image forming means for forming an image of an area designated by said area designating means;

magnification setting means for setting a magnification for forming images; and synthesizing means for forming images of a first and second area corresponding to said area information output from said area designating means on a same recording material;

wherein said image forming means adopt mutually different image magnifications for the formation of images in said first and second areas and wherein the value of said image magnification for said first area can be set by said magnification setting means at a desired value and wherein said first and second areas are contained in a same original image.

41. An image forming apparatus according to claim 40, wherein said synthesizing means controls said image forming means so as to form said images of said first and second areas.

42. An image forming apparatus according to claim 40, wherein said first area is obtained by extracting a designated area of said original image.

43. An image forming apparatus according to claim 40, wherein said second area is obtained by erasing a designated area of said original image.

44. An image forming apparatus according to claim 40, wherein said image forming means forms the image of said first area on a recording sheet and thereafter forms the image of said second area on the same recording sheet.

45. An image forming apparatus according to claim 44, wherein said image forming means comprises transfer means for transferring the image formed on a photosensitive material onto said recording sheet and said control means multiply transfers the image of said second area onto said recording sheet onto which the image of said first area has been transferred.

46. An image forming apparatus according to claim 45, wherein said control means includes feeding means for repeatedly and automatically feeding to said transfer means said recording sheet on which said image of said first area has been transferred.

47. An image forming apparatus according to claim 40, wherein said images of said first and second areas are formed in different colors.

48. An image forming apparatus comprising:

area designating means for designating a desired area of an original image, wherein said area designating means outputs area information indicating said designated area;

image forming means for forming the image of an area designated by said area designating means;

magnification setting means for setting a magnification for forming images; and synthesizing means for controlling said image forming means so as to form images of a first and second area corresponding to said area information output from said area designating means on a same recording material;

wherein said image forming means adopt mutually different image magnifications for the formation of images in said first and second areas and wherein said image of said first area is formed with a desired magnification set by said magnification setting means regardless of the size of said second area.

49. An image forming apparatus according to claim 48, wherein said first area is obtained by extracting a designated area of said original image.

50. An image forming apparatus according to claim 48, wherein said second area is obtained by erasing a designated area of said original image.

51. An image forming apparatus according to claim 48, wherein said image forming means forms the image of said first area on a recording sheet and thereafter forms the image of said second area on the same recording sheet.

52. An image forming apparatus according to claim 51, wherein said image forming means comprises transfer means for transferring the image formed on a photosensitive material onto said recording sheet and said control means multiply transfers the image of said second area onto said recording sheet onto which the image of said first area has been transferred.

53. An image forming apparatus according to claim 52, wherein said control means includes feeding means for repeatedly and automatically feeding to said transfer means said recording sheet on which said image of said first area has been transferred.

* * * * *

UNITED STATES PATENT AND TRADEMARK OFFICE

CERTIFICATE OF CORRECTION

PATENT NO. : 4,803,520

DATED : February 7, 1989

INVENTOR(S) : MASAHIRO TOMOSADA ET AL.

It is certified that error appears in the above-identified patent and that said Letters Patent is hereby corrected as shown below:

COLUMN 2

Figure 6:
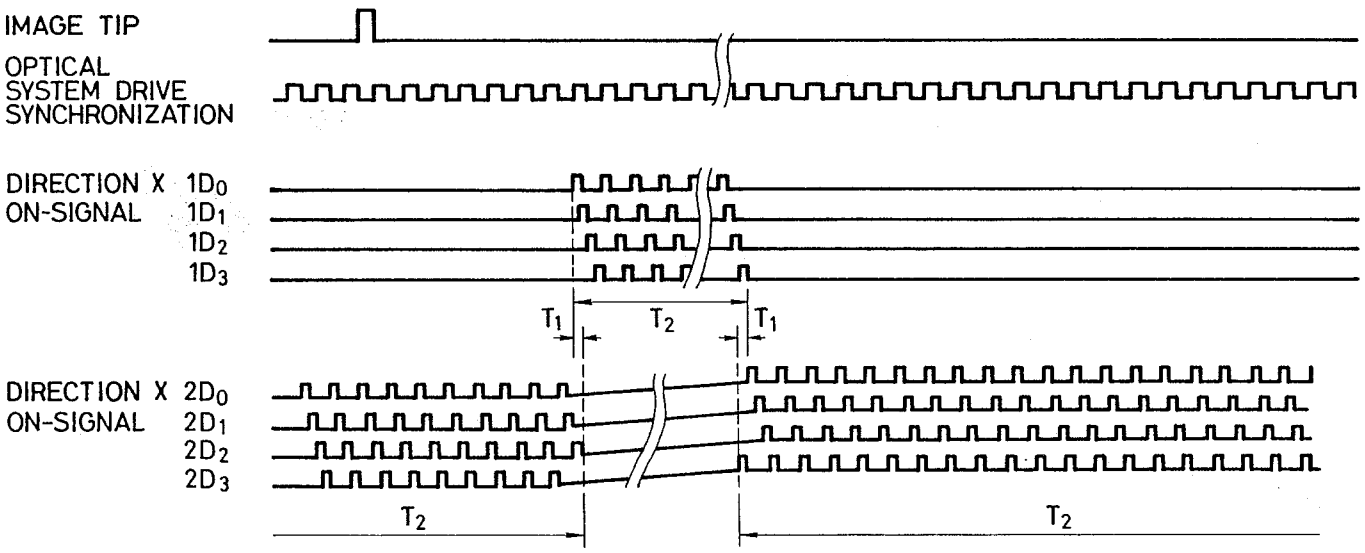
FIG. 6 timing chart showing signals of said block in FIG. 5.

Line 36, "FIG. 5" should read --FIG. 5 is a--.
Line 38, "FIG. 6" should read --FIG. 6 is a--.
Line 40, "a," should read --a--.

COLUMN 5

Line 27, "septs 49, 50 and +$\alpha$and -$\alpha$" should read --steps 49, 50 and +$\alpha$and -$\alpha$--.

COLUMN 6

Line 37, "in" should be deleted.
Line 47, "area recording" should read --a recording--.

COLUMN 7

Line 32, "claim 1," should read --claim 36,--.

UNITED STATES PATENT AND TRADEMARK OFFICE

CERTIFICATE OF CORRECTION

PATENT NO. : 4,803,520

DATED : February 7, 1989

INVENTOR(S) : MASAHIRO TOMOSADA ET AL.

It is certified that error appears in the above-identified patent and that said Letters Patent is hereby corrected as shown below:

COLUMN 9

Line 35, "ar" should read --or--.

Signed and Sealed this

Nineteenth Day of September, 1989

*Attest:*

DONALD J. QUIGG

*Attesting Officer*

*Commissioner of Patents and Trademarks*